US007007992B2

(12) United States Patent
Young

(10) Patent No.: US 7,007,992 B2
(45) Date of Patent: Mar. 7, 2006

(54) INTERNAL TUBE GRIPPING DEVICE

(76) Inventor: Freddie W. Young, 10427 Shoe Creek Dr., Baton Rouge, LA (US) 70818

( * ) Notice: Subject to any disclaimer, the term of this patent is extended or adjusted under 35 U.S.C. 154(b) by 22 days.

(21) Appl. No.: 10/715,588

(22) Filed: Nov. 18, 2003

(65) Prior Publication Data

US 2004/0239132 A1 Dec. 2, 2004

Related U.S. Application Data

(60) Provisional application No. 60/427,784, filed on Nov. 20, 2002.

(51) Int. Cl.
*B66C 1/56* (2006.01)

(52) U.S. Cl. ..... 294/97; 294/119; 414/910; 414/911

(58) Field of Classification Search ..... 294/93, 294/97, 111, 112, 118, 119; 414/910, 911
See application file for complete search history.

(56) References Cited

U.S. PATENT DOCUMENTS

| | | | | |
|---|---|---|---|---|
| 277,532 A | | 5/1883 | Ash | |
| 473,127 A | * | 4/1892 | Plumb | 452/191 |
| 485,944 A | * | 11/1892 | Jones | 294/97 |
| 728,110 A | * | 5/1903 | Jenkins | 248/99 |
| 764,281 A | | 7/1904 | Duncan | |
| 950,437 A | * | 2/1910 | Coley | 294/97 |
| 1,171,580 A | * | 2/1916 | Atterbury | 294/81.5 |
| 2,610,889 A | | 9/1952 | Penn | |
| 2,778,671 A | | 1/1957 | Langston | |
| 2,794,669 A | | 6/1957 | Schardinger | |
| 2,923,569 A | | 2/1960 | Milliron | |
| 4,531,771 A | | 7/1985 | Bullock | |
| 4,576,407 A | * | 3/1986 | Lambert | 294/97 |
| 2002/0096897 A1 | | 7/2002 | Cornardo et al. | |

FOREIGN PATENT DOCUMENTS

| | | | | |
|---|---|---|---|---|
| SU | 206065 | * | 11/1968 | 294/97 |

* cited by examiner

*Primary Examiner*—Dean J. Kramer
(74) *Attorney, Agent, or Firm*—Jones, Walker, Waechter, Poitevent, Carrere & Denegre, L.L.P.

(57) ABSTRACT

An internal tube gripping device having first and second gripping arms including elongated sections with a central axis and gripping ends attached thereto and angled sections extending non-parallel to the central axis and including connecting ends attached thereto. Pivotally attached to the first and second gripping arms are separately formed first and second link members each having first and second ends. At least one tensioning member is connected to the second ends of the first and second link members.

7 Claims, 3 Drawing Sheets

PART "A"
Half Scale
(2 Required)

PART "B"
Half Scale
(2 Required)

ISO VIEW
PULLING CARPET ROLL
Not to Scale

ISO VIEW
ENTERING CARPET ROLL
Not to Scale

INTERNAL TUBE GRIPPING DEVICE

PRIORITY CLAIM

This application claims the benefit of Provisional application Ser. No. 60/427,784 filed on Nov. 20, 2002, which is incorporated by reference herein in its entirety.

DETAILED DESCRIPTION

Figure 1:
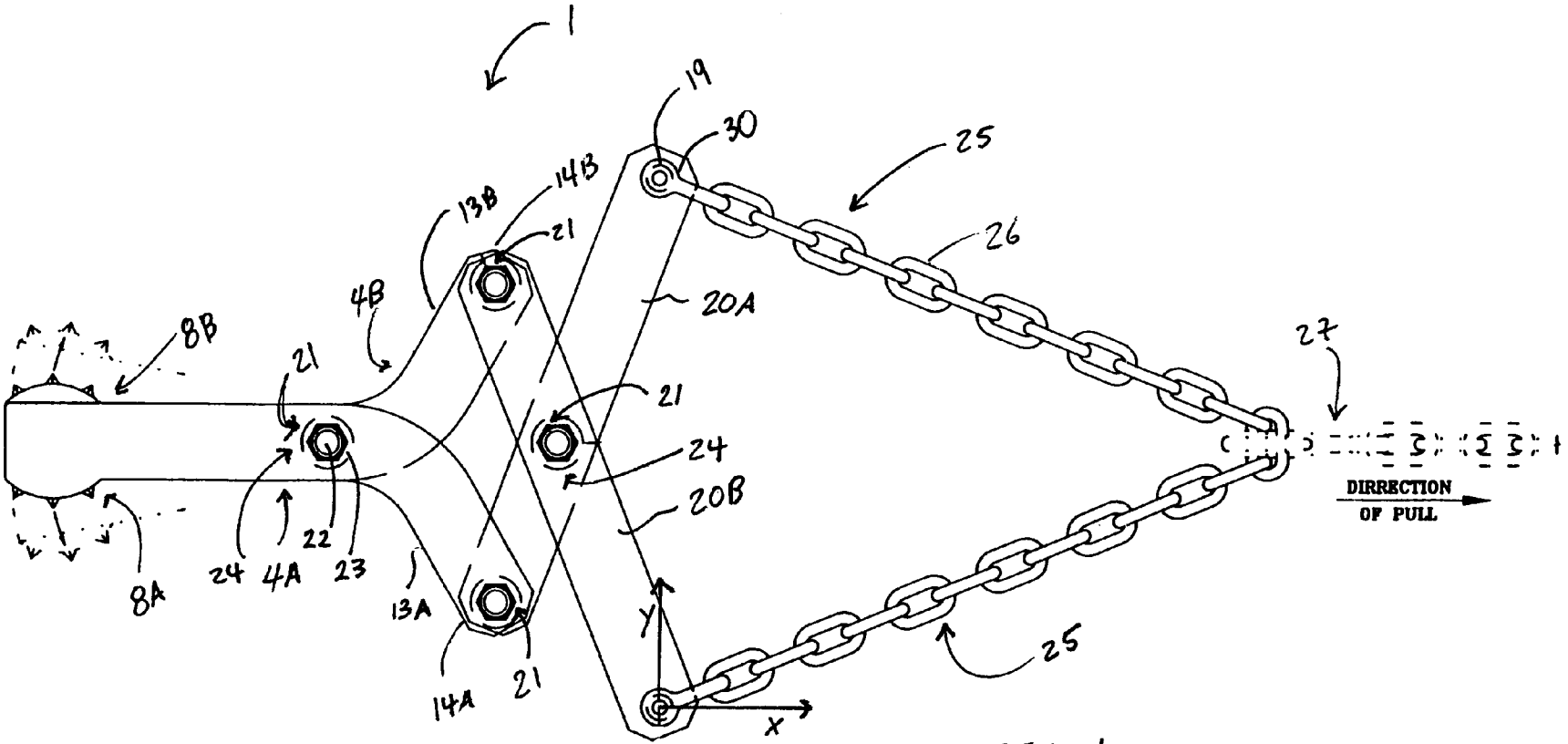
FIG. 1 is a top view of one embodiment of the internal tube gripping device of the present invention.
Figure 2A:
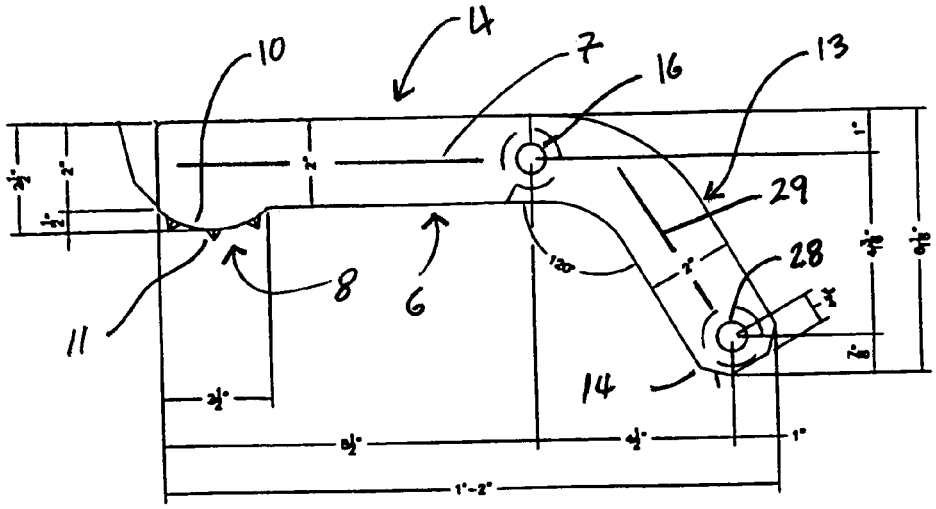
FIG. 2A is a top view of one embodiment of the gripping arm of the device seen in FIG. 1.

FIG. 1 illustrates one embodiment of the present invention, internal tube gripping device 1. Gripping device 1 generally comprises two gripping arms 4A and 4B, two link members 20A and 20B, and flexible tensioning members 25. Gripping arm 4A is more clearly seen in FIG. 2A. In this embodiment, gripping arm 4B is substantially the mirror opposite of gripping arm 4A when assembled into gripping device 1. Both gripping arms 4 may be cast or stamped from the same mold or design and one gripping arm rotated 180° on its central axis 7 when the device is assembled. Where the letter "A" follows a reference number, it is presumed that there is a substantially identical element with the same reference number followed by the letter "B". However, for brevity, a reference number may be used herein without including the "A" or "B" when the description pertains to both the "A" and "B" elements.

All methods of manufacturing gripping arms 4 (or link members 20), e.g., casting, stamping, milling, etc. are intended to come within the scope of the present invention. In one embodiment, gripping arm 4 will include an elongated section 6 running substantially parallel to center axis 7. One end of elongated section 6 will include gripping end 8 which has an arcuate enlarged section 10 with teeth 11. The opposite end of elongated section 6 has angled section 13. In the embodiment shown, a centerline 29 of angled section 13 will be oriented at an angle of approximately 120° with center axis 7. However, other angles could be employed with correspondingly different lengths of gripping arms and link members. Naturally, other angles for angled section 13 are within the scope of the present invention. Gripping arm 4 will include one pivot aperture 16 at about the juncture of elongated section 6 and angled section 13 and a second pivot aperture 28 at the opposite end of angled section 13. In the embodiment shown in FIG. 2A, the overall length of elongated section 6 between pivot aperture 16 and the end of gripping end 18 (parallel to center line 7) will be about 8.5 inches. The horizontal dimension (i.e., parallel to center line 7) of angled section 13 in this embodiment is about 4.5 inches and the vertical dimension (i.e., perpendicular to center line 7) is about 6.5 inches.

Figure 2B:
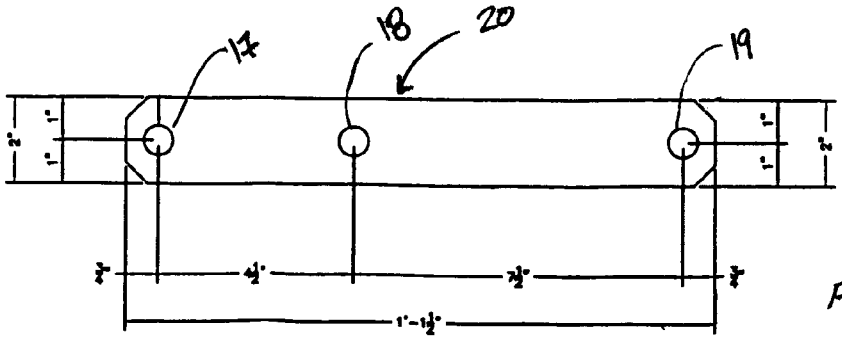
FIG. 2B is a top view of one embodiment of the linking member of the device seen in FIG. 1.

FIG. 2B illustrates an embodiment of a link member 20 as seen in FIG. 1. Link member 20 is a straight section having three pivot apertures: front aperture 17, mid aperture 18, and rear aperture 19. As seen in FIG. 2B, mid aperture 18 is not necessarily positioned halfway down the length of link member 20. For example, in one embodiment the overall length of link member 20 may be 13.5 inches with mid aperture 18 being 4.5 inches from front aperture 17 and 7.5 inches from rear aperture 19. In the embodiment shown, both gripping arms 4 and link members 20 are formed of steel bar stock about 2 inches in width and ⅜ inches thick, although many different widths and thicknesses of materials could be employed. Of course, neither gripping arms 4 nor link members 20 are limited to any particular dimensions described above and other embodiments of the present invention could have greatly varying dimensions. Nor is the material from which gripping arms 4 or link members 20 are constructed limited to steel, but could include tensile aluminum, still other metals or alloys, high strength plastics, or any other material which can withstand the stress placed on the gripping device 1 when in use.

Returning to FIG. 1, it can be seen how in the embodiment shown gripping arm 4A is positioned on top of gripping arm 4B and pivotally secured thereto by way of a pivot means 24 which in the embodiment shown is a pivot pin 21 such as a bolt 22 with a nut 23 threaded thereon. The term "pivot pin" is not limited to a bolt and could include any structure pivotally connecting the two gripping arms together. The link aperture 28 on each of the gripping arms 4 will be connected to the front aperture 17 of a corresponding link member 20 by way of a pivot means 24 (e.g., pivot pin 21). Additionally, the link members 20 will be pivotally connected at their mid-aperture 18 by way of a pivot means 24 (e.g., pivot pin 21). A flexible tensioning member 25 such as chain segment 26 will be attached by a shackle 30 or other device to each rear aperture 19 on link members 20. In the embodiment shown, it is preferable that tensioning members 25 be of equal length in order to apply equal direction and magnitude of force on the link members. In the illustrated embodiment, a central tensioning member or chain 27 is shown attached to the chain segments 26 extending from each link member 20. Central tensioning member 27 may take the same form as tensioning members 25 or may take a different form. It can be seen in the embodiment of FIG. 1 that the chain segments 26 are joined such that when tension is applied to the ends of chain segments 26, a force is exerted on the end of link members 20 at an inward angle, thereby creating a force component in both the "x" and the "y" directions as indicated in FIG. 1. Although force in the x-direction tends to pull gripping arms 4 out of roll tube 41 (described below in reference to FIGS. 3A and 3B), force in the y-direction simultaneously tends to press teeth 11 more forcefully into the inner surface of roll tube 41. While chain segments 26 are shown in the embodiment of FIG. 1, flexible tensioning member 25 could be steel cable, rope or a cord of any other material with sufficient tensile strength to allow a roll of material to be moved. Embodiments may include two separate tensioning members 25 separately or joined together, or a single tensioning member 25 connected to rear apertures 19 of link members 20 and also to central tensioning member 27. Other embodiments may include rigid tensioning members.

Figure 3A:
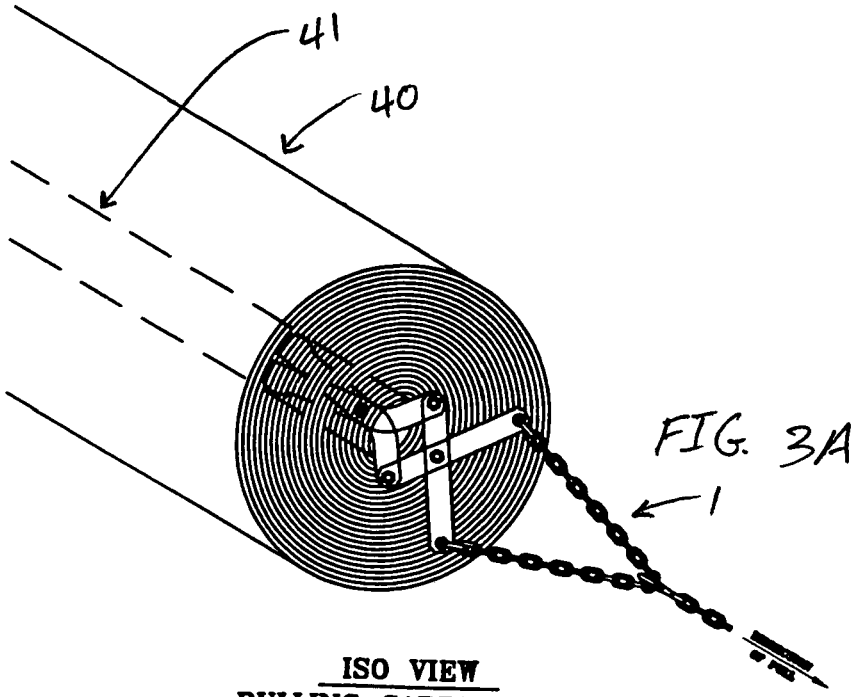
FIG. 3A illustrates the device of FIG. 1 inserted into a roll of material.
Figure 3B:
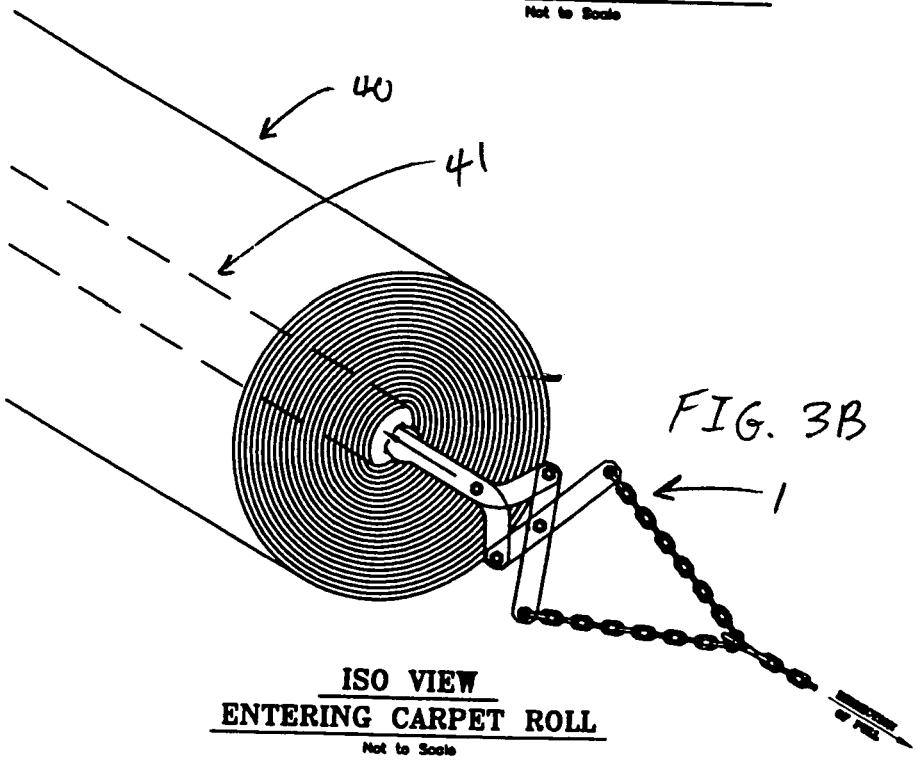
FIG. 3B illustrates the device of FIG. 1 prior to being inserted into a roll of material.

FIGS. 3A and 3B represent how certain embodiments of the invention will be utilized. FIG. 3B shows a roll of carpet or other material 40 (e.g. bulk paper, plastic, corrugated materials, roofing materials, etc.) which has a roll tube 41 which typically is of thick paper or cardboard. Gripping device 1 with the gripping arms 4 closed together and overlapping one another is inserted into roll tube 41. Pushing together the rear portions of link members 20 will cause the gripping ends 8 to spread and teeth 11 to engage the inner wall of roll tube 41. Thereafter, placing tension on chain segments 26 not only exerts a pulling force on roll 40, but also causes teeth 11 to more forcefully press against the inner wall of roll tube 41 as discussed above in reference to the y-direction force. When it is desired to release roll 40 from gripping device 1, it is only necessary to release tension on chain segments 26. If teeth 11 have become deeply embedded in roll tube 41, slight pressure forcing the ends of link members 20 forward will cause teeth 11 to disengage roll tube 41.

Although the present invention has been described in terms of specific embodiments, many variations and modifications will be apparent to those of skill in the art. For example, the gripping teeth 11 may be modified to better grip many different materials from which the roll tube is constructed, whether that material be cardboard, plastic, or composite materials from wood and plastic. As another example, the invention could include a method of manufacturing an internal tube gripping device comprising the steps of: forming first and second gripping arms having an elongated section with a central axis and a gripping end attached thereto and an angled section extending non-parallel to said central axis and having a connecting end attached thereto; pivotally attaching said first and second gripping arms; forming separate first and second link members having first and second ends, said first ends being pivotally connected to said connecting end of said first and second gripping members; pivotally attaching said first and second link members; and connecting tensioning members to said second ends of said first and second link members. All such variations and modifications are intended to come within the scope of the following claims.

I claim:

1. An internal tube gripping device comprising:

a. a first gripping arm comprising an elongated section with a central axis and a gripping end attached thereto and an angled section extending non-parallel to said central axis and comprising a connecting end attached thereto;

b. a second gripping arm, shaped substantially the same as said first gripping arm, but oriented in an opposite direction and pivotally attached to said first gripping arm;

c. a separately formed first link member comprising first and second ends, said first end being pivotally connected to said connecting end of said first gripping arm;

d. a separately formed second link member pivotally connected to said first link member and comprising first and second ends, said first end being pivotally connected to said connecting end of said second gripping arm;

e. wherein said link members have front, rear, and mid-pivot apertures and said mid-pivot aperture is closer to said front pivot aperture than to said rear pivot aperture; and f. at least one tensioning member connected to said second ends of said first and second link members.

2. The internal tube gripping device of claim 1, wherein said gripping end further comprises a series of teeth integrally formed thereon.

3. The internal tube gripping device of claim 1, wherein said first and second gripping arms are offset and overlap along said elongated sections.

4. The internal tube gripping device of claim 1, wherein said at least one tensioning member is flexible.

5. The internal tube gripping device of claim 4, further comprising a flexible tensioning member connected to each of said first and second link members, wherein said flexible tensioning members are connected to a central tensioning member.

6. An internal tube gripping device comprising:

a. a first gripping means comprising an elongated section with a central axis and a gripping end attached thereto and an angled section extending non-parallel to said central axis and comprising a connecting end attached thereto;

b. a second gripping means, shaped substantially the same as said first gripping means, but oriented in an opposite direction and pivotally attached to said first gripping means;

c. a separately formed first link means comprising first and second ends, said first end being pivotally connected to said connecting end of said first gripping means;

d. a separately formed second link means comprising first and second ends, said first end being pivotally connected to said connecting end of said second gripping means;

e. wherein said link means have front, rear, and mid-pivot apertures and said mid-pivot aperture is closer to said front pivot aperture than to said rear pivot aperture; and f. a tensioning means connected to said second ends of said first and second link means.

7. A method of pulling a roll of material comprising an internal roll tube, said method comprising the steps of:

a. providing a gripping device comprising:

i. a first gripping arm comprising an elongated section with a central axis and a gripping end attached thereto and an angled section extending non-parallel to said central axis and comprising a connecting end attached thereto;

ii. a second gripping arm, shaped substantially the same as said first gripping arm, but oriented in an opposite direction and pivotally attached to said first gripping arm;

iii. a separately formed first link member comprising first and second ends, said first end being pivotally connected to said connecting end of said first gripping arm;

iv. a separately formed second link member comprising first and second ends, said first end being pivotally connected to said connecting end of said second gripping arm;

v. wherein said link members have front, rear, and mid-pivot apertures and said mid-pivot aperture is closer to said front pivot aperture than to said rear pivot aperture; and vi. tensioning members connected to said second ends of said first and second link members;

b. inserting said gripping device into said roll tube; and c. applying a tensioning force on said tensioning members.

* * * * *